US008267752B2

(12) United States Patent
Chang

(10) Patent No.: US 8,267,752 B2
(45) Date of Patent: Sep. 18, 2012

(54) KNIFE SHARPENING DEVICE OF CIRCULAR KNIFE

(76) Inventor: Pi-Chao Chang, Taichung Hsien (TW)

( * ) Notice: Subject to any disclaimer, the term of this patent is extended or adjusted under 35 U.S.C. 154(b) by 310 days.

(21) Appl. No.: 12/779,280

(22) Filed: May 13, 2010

(65) Prior Publication Data

US 2011/0277594 A1 Nov. 17, 2011

(51) Int. Cl.
*B24B 3/46* (2006.01)

(52) U.S. Cl. ..... 451/419; 451/45; 76/82

(58) Field of Classification Search ..... 451/45, 451/293, 359, 349, 549, 557, 558; 76/82, 76/85; *B42B 3/46*
See application file for complete search history.

(56) References Cited

U.S. PATENT DOCUMENTS

| | | | | |
|---|---|---|---|---|
| 1,622,476 | A * | 3/1927 | Turi | 451/555 |
| 1,644,778 | A * | 10/1927 | Gibson | 451/278 |
| 2,721,430 | A * | 10/1955 | Green et al. | 451/422 |
| 3,163,964 | A * | 1/1965 | Wheeler | 451/278 |
| 3,979,857 | A * | 9/1976 | Kobylarz | 451/293 |
| 5,499,943 | A * | 3/1996 | Terris | 451/549 |
| 5,660,582 | A * | 8/1997 | Terris | 451/359 |
| 6,161,689 | A * | 12/2000 | Reithel | 206/303 |
| 6,446,797 | B1 * | 9/2002 | Shiga | 206/303 |
| 6,634,257 | B2 * | 10/2003 | Long et al. | 76/86 |
| 7,238,096 | B2 * | 7/2007 | Scott | 451/349 |

FOREIGN PATENT DOCUMENTS

JP 10202485 A * 8/1998

* cited by examiner

*Primary Examiner* — Joseph J Hail
*Assistant Examiner* — Joel Crandall

(57) ABSTRACT

A knife sharpening device of a circular knife contains a wheel member including a sharpening portion disposed therein, the sharpening portion including an abrasive piece mounted therearound, an annular loop with a hole mounted on a central portion thereof, and a peripheral wheel formed therearound; a retaining member connected with one side of the wheel member and including a first rib disposed thereon, an abutting post with a first limiting block extending therefrom, the first limiting block including an insertion extending therefrom, the abutting post including a biasing projection proximate to the abutting post; a connecting member connected on another side of the wheel member and including a second rib disposed thereon, a second limiting block with an opening and plural locking tabs fixed on a central portion of an inner side thereof, the connecting member including a contacting peg arranged adjacent to an inner side thereof.

8 Claims, 5 Drawing Sheets

KNIFE SHARPENING DEVICE OF CIRCULAR KNIFE

BACKGROUND OF THE INVENTION

1. Field of the Invention

The present invention relates to a knife sharpening device of a circular knife that can sharpen the circular blade annularly and evenly by rotating the wheel member.

2. Description of the Prior Art

A conventional circular knife is cooperated with a straight rule to cut an object straightly or is matched with a board rule to cut an object into an irregular shape. Such conventional circular knife is fixed to cut the object at a single point or is rotated to cut the object to prevent from break during cutting process.

However, such a conventional circular knife will become blunt after being used after a long period of time. Furthermore, a cutting portion of the circular knife is circular, therefore it has to be rotated continuously to be sharpened in operation, thus having tedious operation and uneven sharpening effect.

The present invention has arisen to mitigate and/or obviate the afore-described disadvantages.

SUMMARY OF THE INVENTION

The primary object of the present invention is to provide a knife sharpening device of a circular knife that can sharpen the circular blade annularly and evenly by rotating the wheel member.

Further object of the present invention is to provide a knife sharpening device of a circular knife that when the wheel member, the retaining member, and the connecting member are connected together and engaged with the circular blades, the first and the second ribs of the retaining member and the connecting member are held by a user securely.

Another object of the present invention is to provide a knife sharpening device of a circular knife that when the retaining member and the connecting member are positioned, the first and the second circular blades are fixed as well so that the circular blades can not rotated with the wheel member to obtain an even sharpening effect.

A knife sharpening device of a circular knife in accordance with a preferred embodiment of the present invention comprises:

a wheel member including a funnel-shaped sharpening portion disposed in an exterior thereof, the sharpening portion including a circular abrasive piece arranged around an inner side thereof and an annular loop mounted on a central portion thereof, the loop including a hole fixed on a central portion thereof, and the sharpening portion including a peripheral wheel formed around an outer side thereof;

a retaining member connected with one side of the wheel member and including a first rib disposed on outer side thereof, wherein the retaining member includes an abutting post extending from a center of an inner side thereof, and the abutting post includes a first limiting block mounted on an outer end thereof, and the first limiting block includes an insertion extending from an outer end thereof, the abutting post includes a biasing projection formed proximate to the abutting post;

a connecting member connected on another side of the wheel member and including a second rib disposed on an outer side thereof, and including a second limiting block fixed on a central portion of an inner side thereof, and the second limiting block including an opening arranged on a center portion thereof, and including a plurality of locking tabs disposed around an outer side thereof, and the connecting member including a contacting peg arranged adjacent to an inner side thereof.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
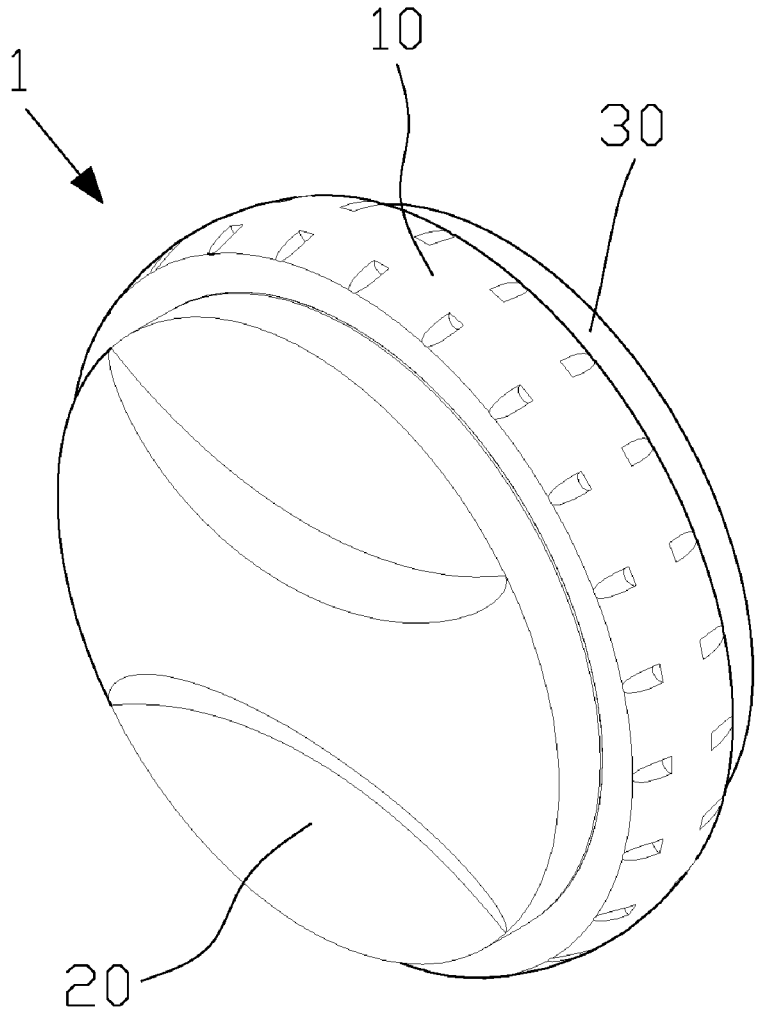
FIG. 1 is a perspective view showing the assembly of a knife sharpening device of a circular knife according to a preferred embodiment of the present invention.
Figure 2:
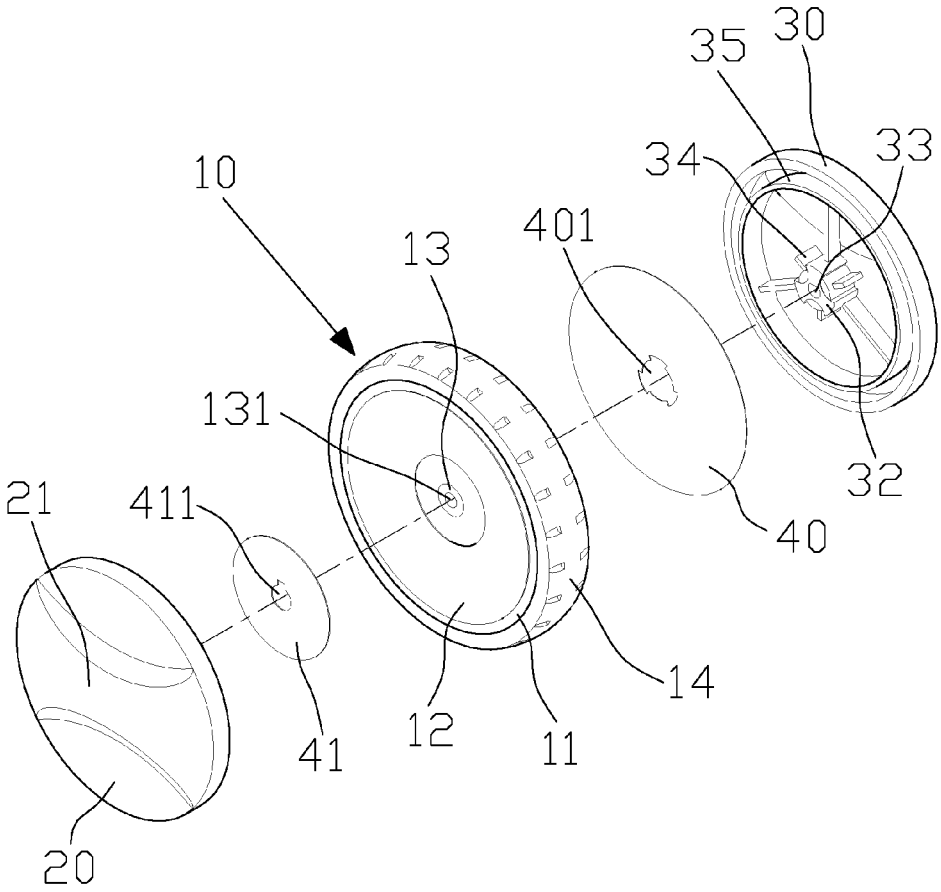
FIG. 2 is a perspective view showing the exploded components of the knife sharpening device of the circular knife according to the preferred embodiment of the present invention.
Figure 3:
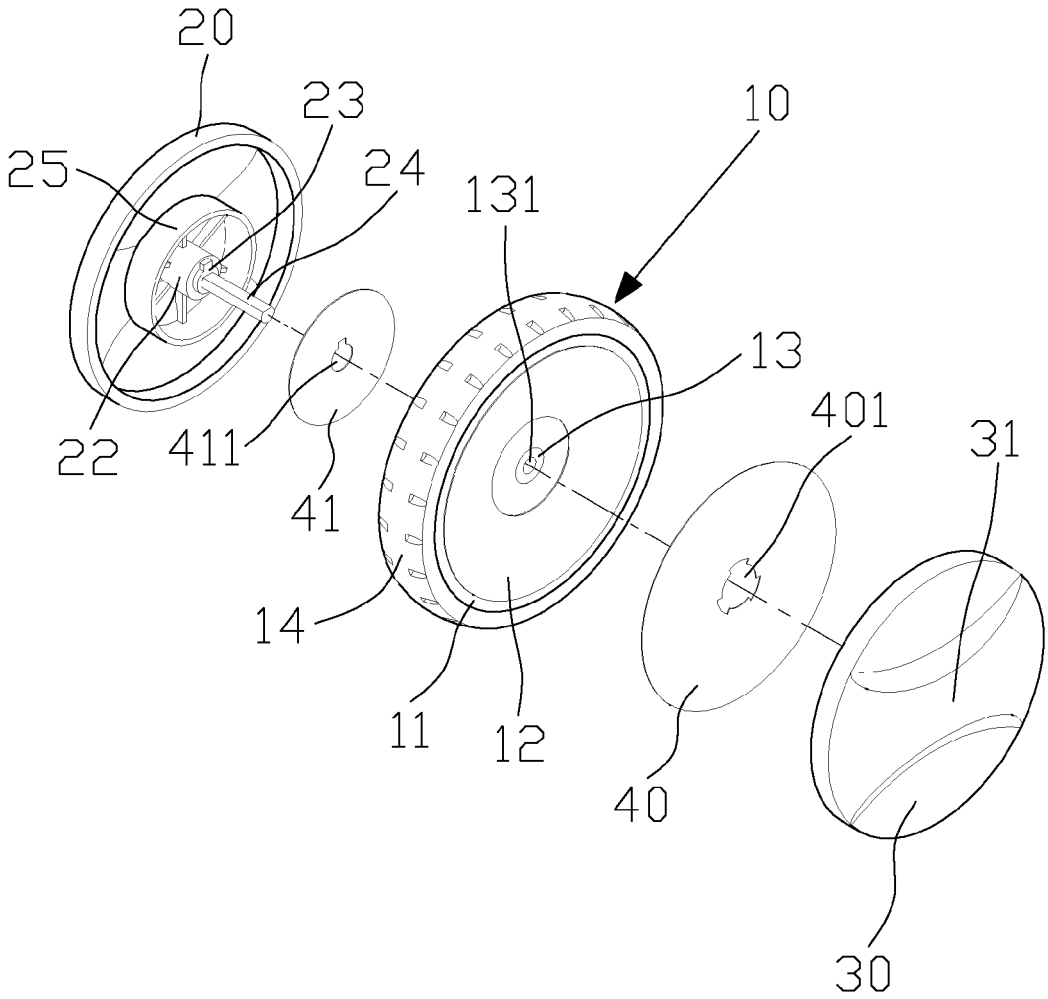
FIG. 3 is another perspective view showing the exploded components of the knife sharpening device of the circular knife according to the preferred embodiment of the present invention.

Referring to FIGS. 1-3, a knife sharpening device 1 of a circular knife in accordance with a preferred embodiment of the present invention comprises a wheel member 10, a retaining member 20, and a connecting member 30, wherein the wheel member 10 includes a funnel-shaped sharpening portion 11 disposed in an exterior thereof, the sharpening portion 11 includes a circular abrasive piece 12 arranged around an inner side thereof and an annular loop 13 mounted on a central portion thereof, the loop 13 includes a hole 131 fixed on a central portion thereof, and the sharpening portion 11 also includes a peripheral wheel 14 formed around an outer side thereof. The retaining member 20 and the connecting member 30 are connected with two sides of the wheel member 10 respectively and include a first and a second ribs 21, 31 disposed on outer sides thereof individually, wherein the retaining member 20 includes an abutting post 22 extending from a center of an inner side thereof, and the abutting post 22 includes a first limiting block 23 mounted on an outer end thereof, and the first limiting block 23 includes an insertion 24 extending from an outer end thereof, the abutting post 22 also includes a biasing projection 25 formed proximate to the abutting post 22. The connecting member 30 includes a second limiting block 32 fixed on a central portion of an inner side thereof, and the second limiting block 32 includes an opening 33 arranged on a center portion thereof, and includes a plurality of locking tabs 34 disposed around an outer side thereof, and the connecting member 30 includes a contacting peg 35 arranged adjacent to an inner side thereof.

A first circular blade 40 includes a first confining orifice 401 in response to the second limiting block 32 of the connecting member 30 so that when the first circular blade 40 is retained with the second limiting block 32, the locking tabs 34 and the contacting peg 35 are biased against an outer side of the first circular blade 40, and a diameter of the contacting peg 35 is less that that of the first circular blade 40. Furthermore, a second circular blade 41 includes a second confining orifice 411 in response to the first limiting block 23 of the retaining member 20 so that when the second circular blade 41 is retained with the first limiting block 23, the abutting post 22 and the biasing projection 25 abut against an outer side of the second circular blade 41, and a diameter of the biasing projection 25 is less that that of the second circular blade 41.

Figure 4:
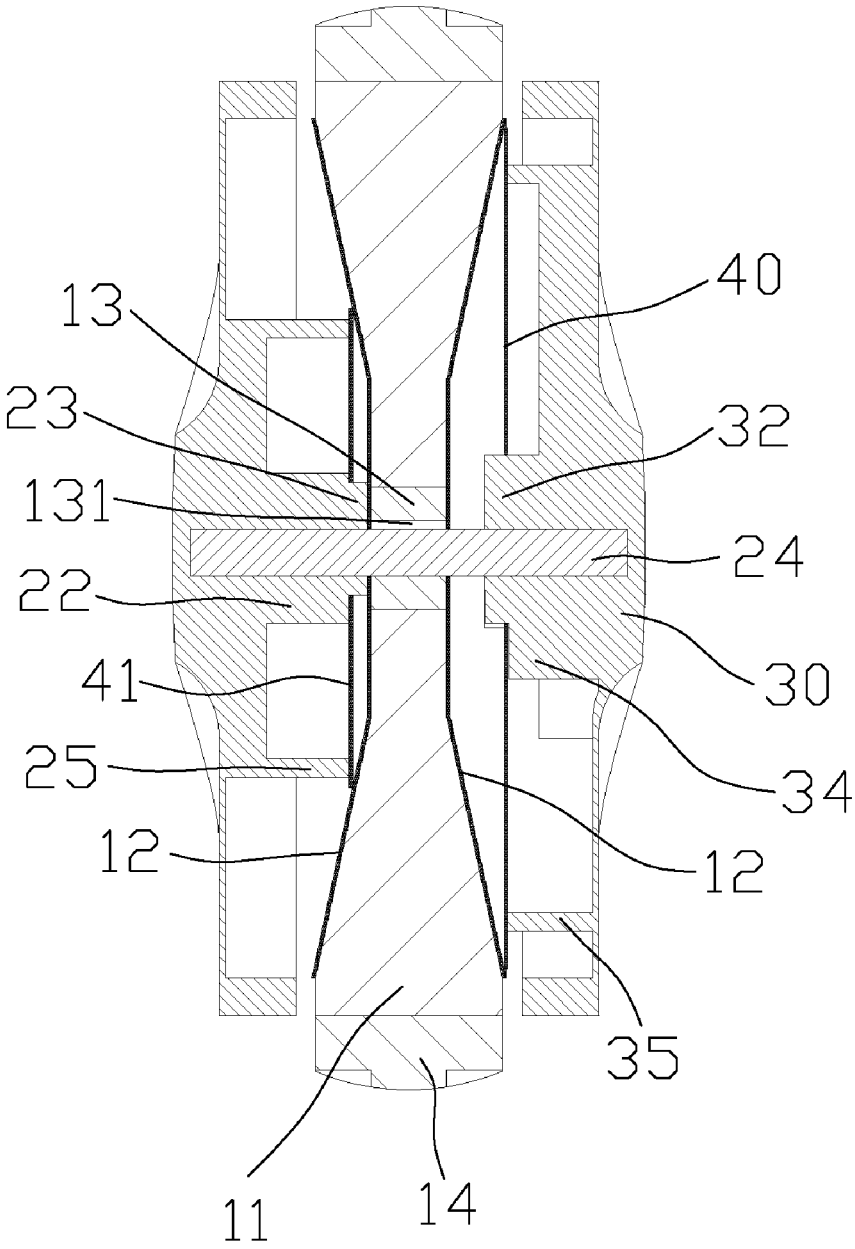
FIG. 4 is a cross sectional view showing the assembly of the knife sharpening device of the circular knife according to the preferred embodiment of the present invention.

Referring further to FIGS. 2-4, the retaining member 20 is inserted into the hole 131 of the wheel member 10 by using the insertion 24 and is retained in the opening 33 of the connecting member 30 so that the first and the second circular blades 40, 41 are abutted against the abrasive piece 12 respectively to have an circular contact with each other. The insertion 24 of the retaining member 20 is not formed in a circle shape, and the opening 33 of the connecting member 30 is formed to correspond to a shape of the insertion 24 so that after the retaining member 20 and the connecting member 30 are connected together, they are positioned by each other by ways of the noncircular structure. The first and the second confining orifices 401, 411 of the first and the second circular blades 40, 41 are in response to the first and the second limiting blocks 23, 32 of the retaining member 20 and the connecting member 30 individually so that when the retaining member 20 and the connecting member 30 are positioned, the first and the second circular blades 40, 41 are fixed as well.

Figure 5:
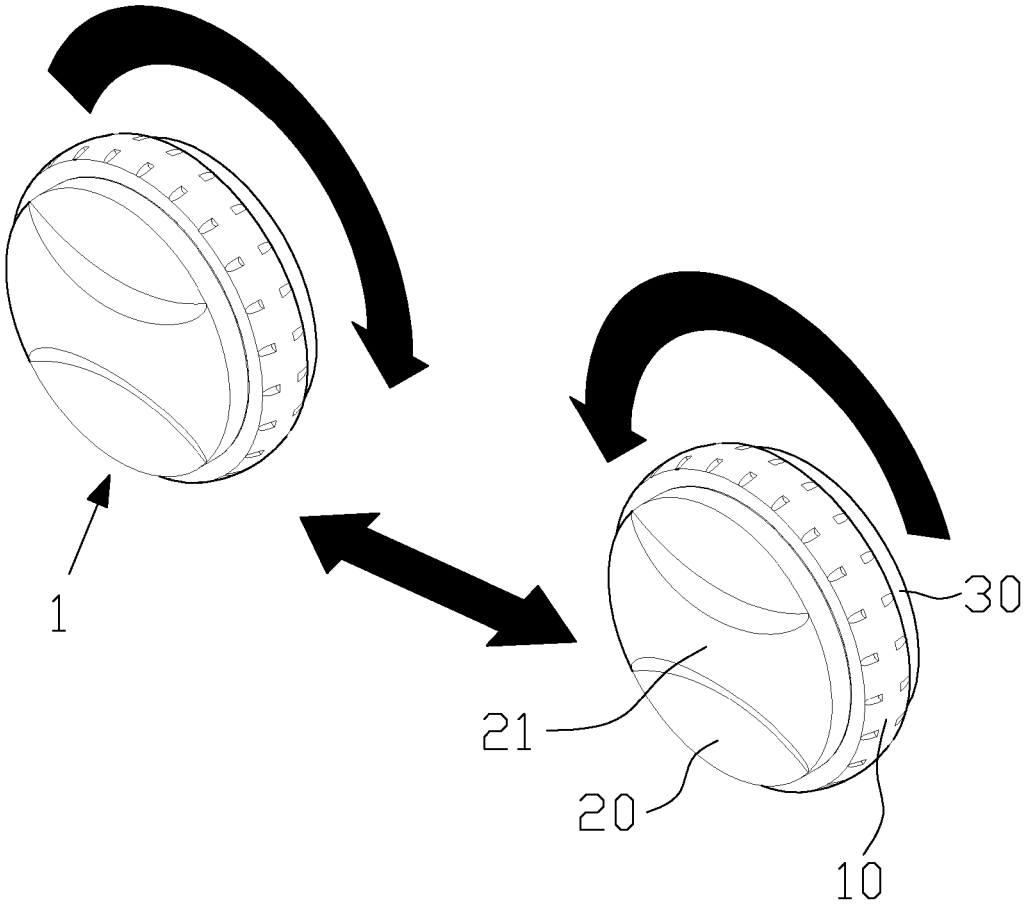
FIG. 5 is a perspective view showing the operation of the knife sharpening device of the circular knife according to the preferred embodiment of the present invention.

As shown in FIG. 5, when the wheel member 10, the retaining member 20, and the connecting member 30 are connected together and engaged with the circular blades, the first and the second ribs 21, 31 of the retaining member 20 and the connecting member 30 are held by a user to be pulled straightly to rotate the wheel member 10, such that the abrasive piece 12 of the wheel member 10 sharpens the circular blades annularly and evenly.

While we have shown and described various embodiments in accordance with the present invention, it is clear to those skilled in the art that further embodiments may be made without departing from the scope of the present invention.

What is claimed is:

1. A knife sharpening device of a circular knife comprising:

a wheel member including a funnel-shaped sharpening portion disposed in an exterior thereof, the sharpening portion including a circular abrasive piece arranged around an inner side thereof and an annular loop mounted on a central portion thereof, the loop including a hole fixed on a central portion thereof, and the sharpening portion including a peripheral wheel formed around an outer side thereof;

a retaining member connected with one side of the wheel member and including a first rib disposed on outer side thereof, wherein the retaining member includes an abutting post extending from a center of an inner side thereof, and the abutting post includes a first limiting block mounted on an outer end thereof, and the first limiting block includes an insertion extending from an outer end thereof, the abutting post includes a biasing projection formed proximate to the abutting post;

a connecting member connected on another side of the wheel member and including a second rib disposed on an outer side thereof, and including a second limiting block fixed on a central portion of an inner side thereof, and the second limiting block including an opening arranged on a center portion thereof, and including a plurality of locking tabs disposed around an outer side thereof, and the connecting member including a contacting peg arranged adjacent to an inner side thereof.

2. The knife sharpening device of the circular knife as claimed in claim 1, wherein a first circular blade includes a first confining orifice in response to the second limiting block of the connecting member so that when the first circular blade is retained with the second limiting block, the locking tabs and the contacting peg are biased against an outer side of the first circular blade.

3. The knife sharpening device of the circular knife as claimed in claim 1, wherein a second circular blade includes a second confining orifice in response to the first limiting block of the retaining member so that when the second circular blade is retained with the first limiting block, the abutting post and the biasing projection abut against an outer side of the second circular blade.

4. The knife sharpening device of the circular knife as claimed in claim 1, wherein the insertion of the retaining member is not formed in a circle shape, and the opening of the connecting member is formed to correspond to a shape of the insertion.

5. The knife sharpening device of the circular knife as claimed in claim 2, wherein a diameter of the contacting peg is less that that of the first circular blade.

6. The knife sharpening device of the circular knife as claimed in claim 3, wherein a diameter of the biasing projection is less that that of the second circular blade.

7. The knife sharpening device of the circular knife as claimed in claim 4, wherein after the retaining member and the connecting member are connected together, they are positioned by each other by ways of a noncircular structure.

8. The knife sharpening device of the circular knife as claimed in claim 7, wherein when the retaining member and the connecting member are positioned, the first and the second circular blades are fixed as well.

* * * * *